US005569334A

United States Patent [19]

Kawata et al.

[11] Patent Number: 5,569,334

[45] Date of Patent: Oct. 29, 1996

[54] STAINLESS STEEL MEMBER FOR SEMICONDUCTOR FABRICATION EQUIPMENT AND SURFACE TREATMENT METHOD THEREFOR

[75] Inventors: Tsunehiro Kawata, Kumagaya; Katsuhiko Kojo, Fukaya; Youichiro Kazama, Kumagaya; Takayuki Fukaya, Kuwana; Toshihiko Tsujimura, Tsu, all of Japan

[73] Assignee: Hitachi Metals, Ltd., Tokyo, Japan

[21] Appl. No.: 162,479

[22] Filed: Dec. 7, 1993

[30] Foreign Application Priority Data

| | | | |
|---|---|---|---|
| Dec. 8, 1992 | [JP] | Japan | 4-351746 |
| Mar. 5, 1993 | [JP] | Japan | 5-044757 |
| Jun. 29, 1993 | [JP] | Japan | 5-158674 |
| Sep. 6, 1993 | [JP] | Japan | 5-246013 |

[51] Int. Cl.[6] ..... C23C 8/10

[52] U.S. Cl. ..... 148/287; 148/240; 148/286; 420/40; 420/44; 420/46; 420/50; 420/52; 420/57; 420/96; 420/97; 420/98; 428/472.1; 428/472.2

[58] Field of Search ..... 148/286, 287, 148/240; 420/40, 44, 46, 50, 52, 57, 96, 97, 98; 428/472.1, 472.2

[56] References Cited

U.S. PATENT DOCUMENTS

| | | | |
|---|---|---|---|
| 4,141,762 | 2/1979 | Yamaguchi et al. | 420/40 |
| 4,518,440 | 5/1985 | Phillips, Jr. | 428/472.2 |
| 4,636,266 | 1/1987 | Asay | 148/240 |
| 5,224,998 | 7/1993 | Ohmi et al. | 266/252 |
| 5,226,968 | 7/1993 | Ohmi et al. | 266/252 |

FOREIGN PATENT DOCUMENTS

| | | |
|---|---|---|
| 64-31956 | 2/1989 | Japan . |
| 1-198463 | 8/1989 | Japan . |
| 2-43353 | 2/1990 | Japan . |
| 2-54751 | 2/1990 | Japan . |

OTHER PUBLICATIONS

ASM Metals Handbook, vol. 5 (Surface Cleaning, Finishing, and Coating), pp. 553 and 560; American Society for Metals: Metals Park, Ohio; 1982.

M. A. Barbosa, "If Stainless Steels Are Self–Passivating, Is It Worth Passivating Them In Nitric Acid?", Corrosion and Protection of Materials Review, vol. 2, No. 5 (Nov.–Dec.), 1983; pp. 2–6. (trans.).

*Primary Examiner*—David A. Simmons
*Assistant Examiner*—Robert R. Koehler
*Attorney, Agent, or Firm*—Finnegan, Henderson, Farabow, Garrett & Dunner

[57] ABSTRACT

Stainless steel member for semiconductor fabrication equipment having a passive state coating on the surface of the stainless steel comprising, in weight percent, 0.1% or less of C, 2.0% or less of Si, 3.0% or less of Mn, 10% or more of Ni, 15 to 25% of Cr, 1.5 to 4.5% of Mo, 0.5% or less of one or more rare earth element and Fe for substantially the whole remainder. Said passive state coating has a pitting potential of at least 900 mV (when the current density of the anode polarization curve determined with a potentiostat in 3.5% aqueous sodium chloride solution is 10 $\mu A/cm^2$) and has a thickness of 0.5 to 20 nm. The invention also includes a surface treatment method for the stainless steel.

11 Claims, 4 Drawing Sheets

FIG. 3
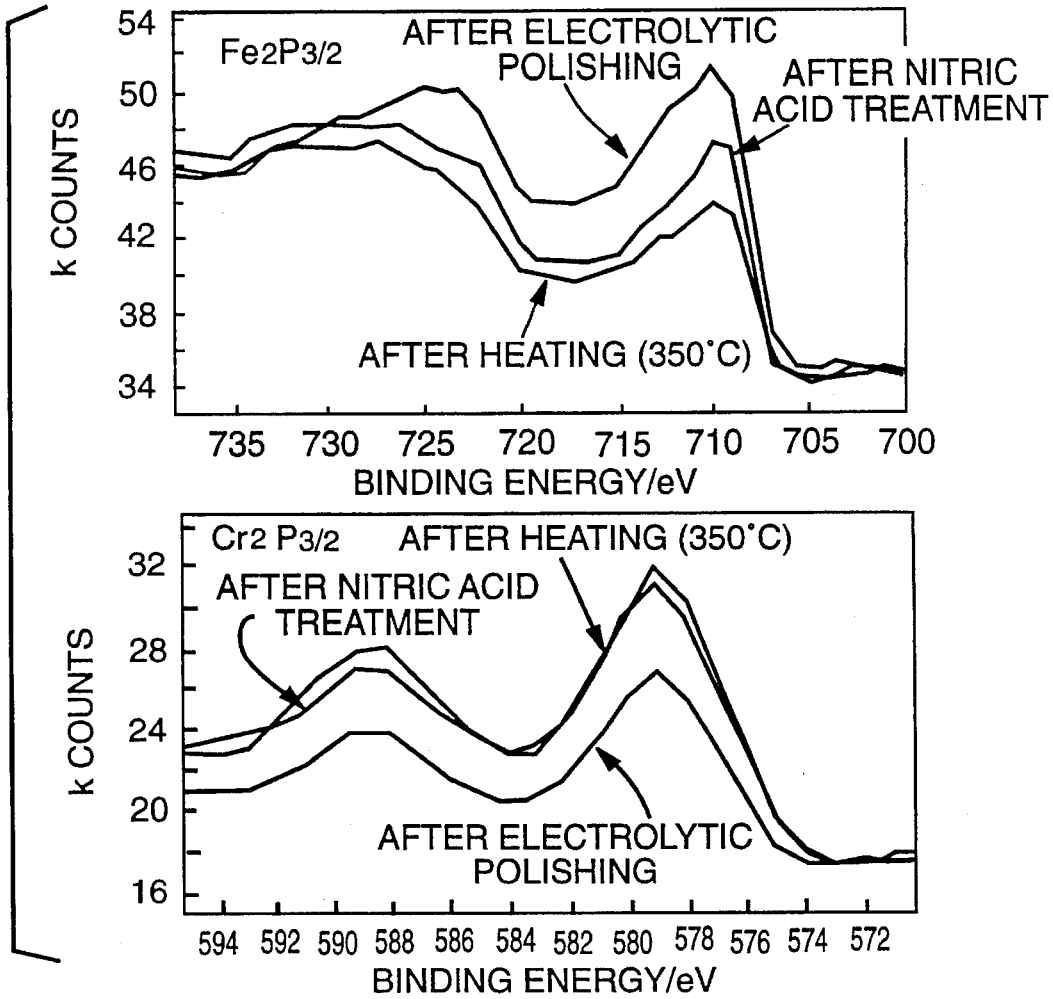
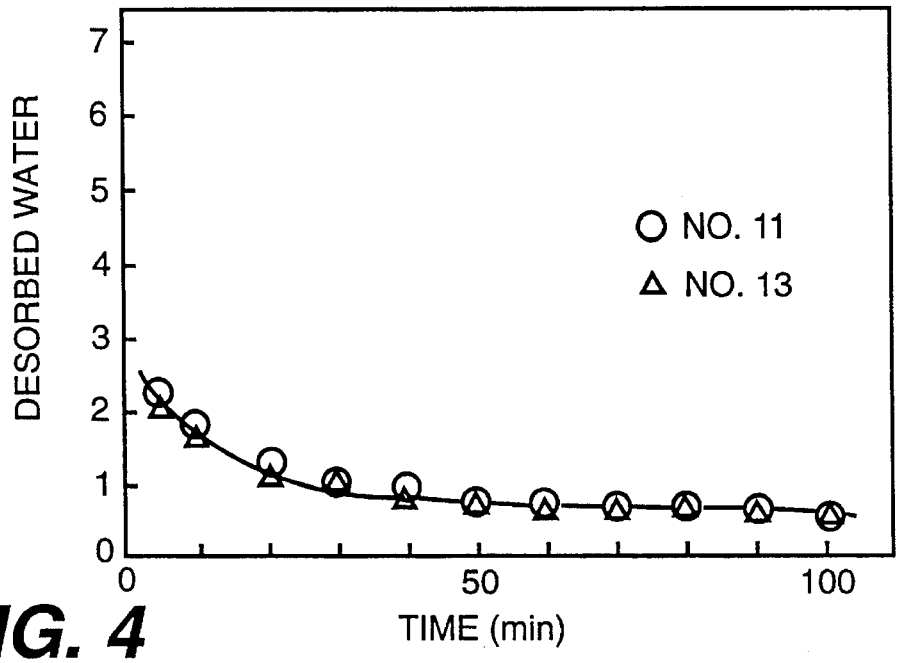
FIG. 4

STAINLESS STEEL MEMBER FOR SEMICONDUCTOR FABRICATION EQUIPMENT AND SURFACE TREATMENT METHOD THEREFOR

FIELD OF THE INVENTION

The present invention relates to stainless steel members used in gas supply piping system for semiconductor fabrication equipment and surface treatment method therefor, and more particularly, relates to high quality stainless steel members with high corrosion resistance and good water desorption property and surface treatment method required to obtain such properties.

BACKGROUND OF THE INVENTION

Semiconductor fabrication process uses many types of gases including dilute gases and special material gases. As the scale of integration in a semiconductor is increased, higher purification is required for such gases. For special material gases, reaction with water content at room temperature generates reaction products, which may cause contamination and corrosion in the gas supply system or process chambers, resulting in particle generation occasionally. Since the minute patterning intervals in a semiconductor circuit are required to have an accuracy of the order of sub microns, such particle generation is undesirable for the fabrication.

With the required purity of the gas used in the semiconductor fabrication process thus becoming increasingly higher, strict requirements are set for the quality of the members for gas piping which supplies high purity gas to the use point in the semiconductor fabrication. Pipe members are required to minimize desorption of water content, metal elements and fine particles.

Conventional method to meet such requirements is to use stainless steel with its internal surface contacting with gases finished with bright-annealing as the piping member or finished with electrolytic polishing which is used recently. Electrolytic finishing improves the smoothness of the surface in contact with the gas and reduces adsorption and desorption of gases resulting in particles such as dusts and corrosive products decreased. The electrolytic polished parts tend to be used more and more.

However, even provided with electrolytic polishing, stainless steel comprising Fe, Cr and Ni is always susceptible to elution of such metal ions. Japanese Patent Application Laid-open No. 31956/1989 discloses measures to suppress elution of metal ions, where the corrosion resistance is improved by thermal treatment of electrolytically polished surface at a temperature from 280° to 580° C. in the atmosphere of 25% or more of oxygen content to form an oxidized coating.

Though the corrosion resistance is certainly improved by the measures disclosed above, highly corrosive gases may corrode the oxidized film coating on the surface, causing the constituents such as Fe, Cr and Ni to elute. The corrosion resistance, and particularly the pitting resistance are still insufficient in such cases.

Further, the stainless steel for semiconductor fabrication equipment is particularly required to have superior water desorption property in addition to corrosion resistance. Specifically, gases for semiconductor fabrication equipment and water desorbed from piping as a gas constituent may cause hydrolysis, generating hydrochloric acid and hydrofluoric acid, which can corrode metal members. Therefore, it is required that the stainless steel for semiconductor fabrication equipment desorbs only a little water. To meet the requirement, Japanese Patent Application Laid-open No. 198463/1989 suggests a method to provide heat oxidization with controlling the dew point of water. However, coating formed by oxidization has much Fe oxide and the stainless steel member with such coating does not have an excellent corrosion resistance.

Thus, there has not been a stainless steel member for semiconductor fabrication equipment with sufficient corrosion resistance and water desorption property at a time.

SUMMARY OF THE INVENTION

It is an object of the present invention to provide a stainless steel member for semiconductor fabrication equipment with excellent corrosion resistance and superior water desorption property and a surface treatment method therefor.

By heating the stainless steel member in an atmosphere with excessively low oxygen content after being immersed in aqueous nitric acid solution, a passive state coating rich in Cr is formed, which has an excellent corrosion resistance, or a pitting potential of 900 mV or more (pitting potential measured when the current density of the anode polarization curve determined with a potentiostat in 3.54 aqueous NaCl solution is 10 $\mu A/cm^2$).

The pitting potential of 900 mV or more can only be achieved by combining the heating process with the immersing treatment in aqueous nitric acid solution. The immersing treatment is well known as a passivation treatment for stainless steel.

According to a preferred embodiment, the thickness of the above passive state coating is 0.5 to 20 nm. When the passive state coating has a thickness below 0.5 nm, its continuity is insufficient; when its thickness is over 20 nm, the coating often has many defects. Both of them tend to cause deterioration of the corrosion resistance.

For a passive state coating richer in Cr than the inside of the steel, the stainless steel is immersed in aqueous nitric acid solution and heated at a temperature from 200° to 900° C. in the atmosphere with 0.1 ppm or less oxygen content. In particular, if the stainless steel member is heated at a temperature from 200° to 400° C., it is easy to cause the surface roughness of the passive state coating on a grain to be Rmax: 30 nm or less. This reduces the specific surface area where water content is adsorbed and thereby improves the water desorption property.

The surface roughness of passive state coating on a grain means the surface roughness of passive state coating formed on the grain excluding the grain boundary. By reducing the specific surface area of passive state coating corresponding to each of grains, the entire member has reduced specific area.

The stainless steel member according to the present invention preferably has the composition as follows (in wt. %): 0.1% or less of C, 2.0% or less of Si, 3.0% or less of Mn, 10% or more of Ni, 15 to 254 of Cr, 1.5 to 4.5% of Mo and Fe substantially for the remaining part.

According to another preferred embodiment, the stainless member of the present invention has the composition as follows (in wt. %): 0.1% or less of C, 2.0% or less of Si, 3.0% or less of Mn, 10% or more of Ni, 15 to 25% of Cr, 1.5 to 4.5% of Mo, 0.5% or less of one or more rare earth element and Fe substantially for the remaining part.

Addition of at least 1.5% of Mo to the composition of the stainless steel member according to the present invention suppresses the elution of metal elements. Similarly, addition of rare earth elements is effective for suppression of metal element elution.

BRIEF DESCRIPTION OF THE DRAWINGS

FIG. 3 is a graph to show the intensity changes of $Fe_2P_{3/2}$ and $Cr_2P_{3/2}$ in the surface coating after electrolytic polishing, nitric acid treatment and heating of the material according to the present invention;

FIG. 4 is a graph to indicate the water desorption from a diaphragm valve for the present invention and a conventional method;

DETAILED DESCRIPTION OF THE INVENTION

Figure 1:
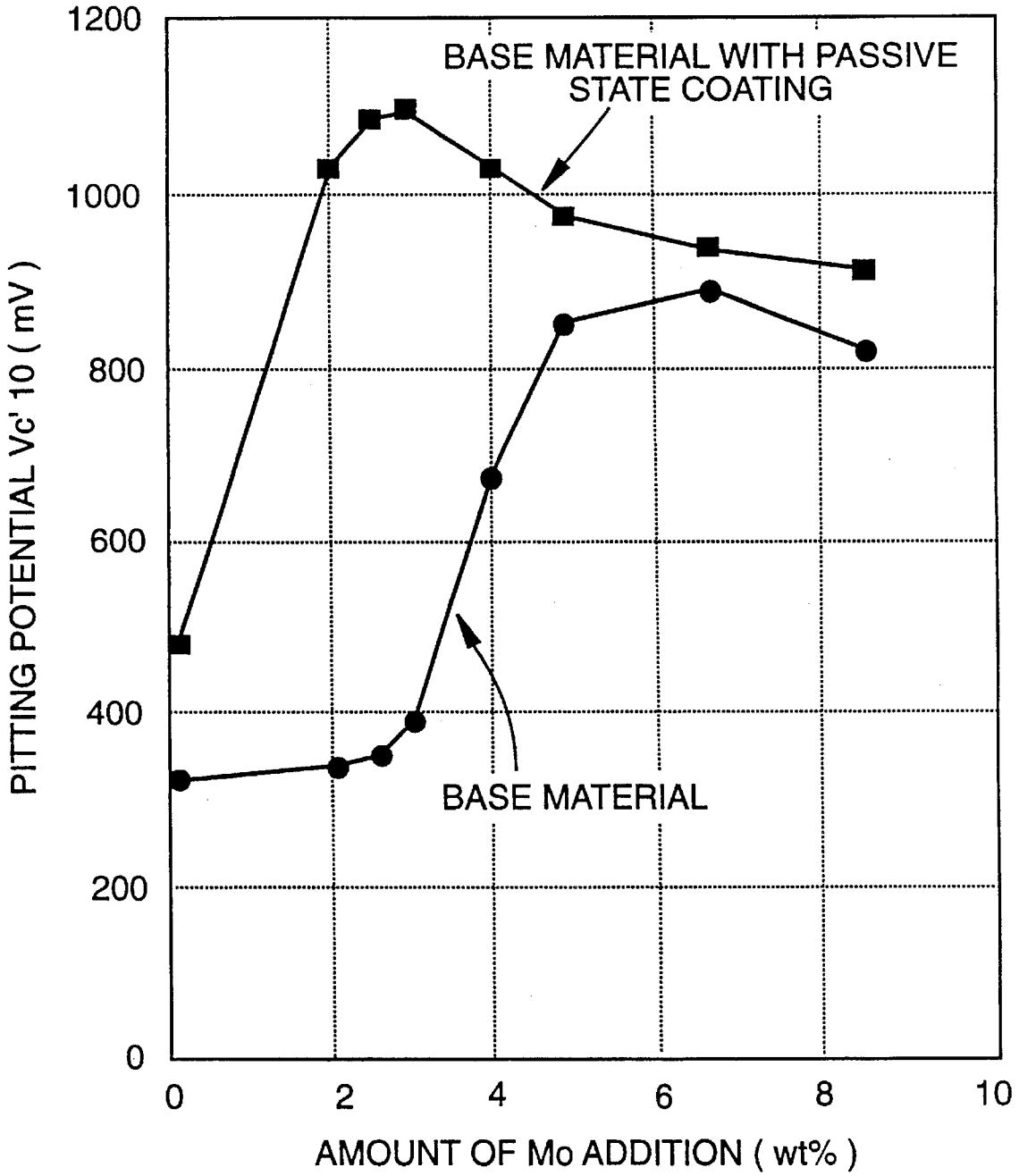
FIG. 1 is a graph to show the relation between the pitting potential measured and added Mo amount for stainless steel members for semiconductor fabrication equipment according to an embodiment of the present invention and a comparative example.

The stainless steel member for semiconductor fabrication equipment of the present invention has an improved corrosion resistance provided by a passive state coating richer in Cr than the inside of the steel formed by immersing the stainless steel in aqueous nitric acid solution; it also has an improved water desorption property with a smaller specific surface area obtained by heating in the atmosphere with 0.1 ppm or less of oxygen content at a temperature of 200° to 900° C. so as to cause the surface roughness of the passive state coating on a grain to be Rmax: 30 nm or less. In particular, with the heating temperature from 200°to 400° C., it is easy to provide the passive state coating of each grain to have a surface roughness of Rmax: 30 nm or less.

When the stainless steel is immersed in aqueous nitric acid solution, Fe on the steel surface elutes into the solution as ions and the remaining Cr is bonded with oxygen to form a coating richer in Cr than the inside of the steel. Since the corrosion resistance of the stainless steel is largely attributable to Cr, the present invention improves the corrosion resistance with concentrating Cr in the surface coating by immersing the steel in the aqueous nitric acid solution.

When the temperature of the aqueous nitric acid solution for immersion is too low, the coating rich in Cr is not formed sufficiently; when it is too high, on the other hand, the water content tends to evaporate, which changes the concentration of the aqueous nitric acid solution. Therefore, it is preferable to keep the temperature of the aqueous solution to be 40° to 70° C.

When the concentration of the aqueous nitric acid solution is too low, the coating is not formed sufficiently; when it exceeds a certain value, it is not preferable from the viewpoint of workers' safety, and in addition, the effect does not become stronger over a certain level. It is preferable to maintain the concentration to be 20 to 50 vol. %.

When the immersion period is too short, the coating is not formed sufficiently, but at a certain duration, the coating formation stops. It is preferable to have 30 to 60 minutes of immersion.

The stainless steel member after immersion process is heated at a temperature from 200° to 900° C. in the atmosphere with 0.1 ppm or less oxygen content.

When the heating process is conducted in an atmosphere with more oxygen, Fe bonds with oxygen with increasing Fe amount in the coating. It is preferable to conduct the process in the atmosphere with oxygen content of 0.1 ppm or less.

When the heating process temperature is below 200° C., the water content cannot be removed sufficiently, but when it is over 900° C., thermal etching occurs with increasing the surface roughness. It is appropriate to conduct the heating process at a temperature from 200°to 900° C., and more preferably, from 200° to 400° C. In this temperature range, it is easy to make the surface roughness of the coating on each grain of the stainless steel to be 30 nm or less (Rmax).

It is more preferable to make the above surface roughness 20 nm or less (Rmax). This further reduces the specific surface area of the coating, which improves the water desorption property.

The coating rich in Cr formed in immersion process contains much bound water. Therefore, heating process causes dehydration, which makes the coating denser. The coating after heating process has a good water elimination property and even when it adsorbs water contents in exposure to the atmosphere, they can be easily eliminated. Besides, even if small amount of water remains in the coating, it is not easily desorbed, which results in a good water desorption property.

It is preferable to make the surface roughness of the stainless steel member Rmax: 1 μm or less by electrolytic polishing prior to the above immersion. This is disclosed in aforementioned Japanese Patent Laid-open No. 31956/1989, smoothing of the surface improves the adherence of the coating.

From analysis of stainless steel member components, it is found that addition of Mo for 1.5 wt % or more suppresses elution of metal elements. Addition of rare earth elements is also effective to reduce metal element elution.

The base material of the stainless steel member of the present invention is preferably the stainless steel comprising, in wt. %, 0.1% or less of C, 2.0% or less of Si, 3.0% or less of Mn, 10% or more of Ni, 15% to 25% of Cr, 1.5 to 4.5% of Mo and Fe for the substantial remaining part.

Further, it is preferable to use as the base material of the stainless steel comprising, in wt. %, 0.1% or less of C, 2.0% or less of Si, 3.0% or less of Mn, 10% or more of Ni, 15% to 25% of Cr, 1.5 to 4.5% of Mo, 0.5% or less of one or more rare earth element and Fe for the substantial remaining part.

C is added for the purpose of austenite promotion as well as strength improvement. If the added content exceeds 0.1 wt. %, carbide generated by C causes grain boundary corrosion, which deteriorates not only the corrosion resistance but also weldability in manufacturing of piping members. It is to be added by 0.1 wt. % at most.

Si is added for deoxidization. When the added amount exceeds 2.0 wt. %, it generates much non-metal inclusion of oxide group. It is to be added by 2.0 wt. % at most.

Mn is added for deoxidization, desulfurization and austenite stabilization. Since its effect is saturated at 3.0 wt. %, it is to be added by 3.0 wt. % at most.

Ni is an forming element required to maintain austenite structure in austenite group stainless steel with improving corrosion resistance and preventing stress corrosion cracking. If it is added less than 10 wt. %, the steel becomes susceptible to delta ferrite forming. It is to be added by 10 wt. % or more.

Cr is added to form a passive state coating on the material surface for corrosion resistance and thermal resistance improvement. When Cr is added less than 15 wt. %, the steel does not have a sufficient corrosion resistance, but when Cr addition exceeds 25 wt. %, the machinability of the steel is deteriorated. Cr is added for 15 to 25 wt. %.

Mo is added for the purpose of corrosion resistance improvement and more particularly, prevention of metal element elution in corrosion environment. Addition of Mo less than 1.5 wt. % provides insufficient effect of metal element elution suppression. When it is over 4.5 wt. %, however, delta ferrite is easily formed resulting in a lower machinability. The added Mo amount is to be 1.5 to 4.5 wt. %.

Rare earth elements fix P and S, which deteriorate the corrosion resistance. Since their effect stops growing at the ratio of 0.5 wt. %, considering their expensiveness, they are added by 0.5 wt. % at most.

As described above, either of the passive state coating and the base material can improve the corrosion resistance and water desorption property. Combination of passive state coating and base material provides stainless steel for semiconductor fabrication equipment much more excellent corrosion resistance and water desorption property.

Though the above description mainly focuses on the pipe member to explain the invention, the stainless steel member for semiconductor fabrication equipment and the surface treatment therefor are also applicable to stainless steel used for other components of semiconductor fabrication equipment.

EXAMPLE 1

Referring to Table 1, 5 mm thick stainless steel test pieces of 15 mm×15 mm with various Mo amounts are buffed so that the surface roughness becomes Rmax: 0.05 μm. For these test pieces, pitting potential measurement test is conducted. Similarly, 5 mm thick test pieces of 15 mm×15 mm with the same composition as Table 1 are subjected to electrolytic polishing so that the surface roughness becomes Rmax: 0.05 μm. They are immersed in aqueous nitric acid solution maintained at 60 ° C. (nitric acid concentration of 30 vol. %) for 20 minutes, cleaned and dried, and then heated at 250° C. for one hour in the atmosphere with excessively low oxygen (0.06 ppm). High purity Ar gas whose water dew point temperature is below −70° C. is used for the atmospheric gas here to obtain excessively low oxygen environment. Then, the pitting potential and the thickness of the passive state coating obtained are measured.

Measurement conditions for the pitting potential and passive state coating thickness are as follows. These conditions are applicable to all examples below.

Pitting Potential

Anode polarization curve is determined with using a potentiostat in 3.5% aqueous NaCl solution.

Passive State Coating Thickness

The thickness of the passive state coating is determined with using Auger electron spectroscopy.

Table 1 shows the results of pitting potential measurement and FIG. 1 shows the relation between the pitting potential measurement results and added Mo amount. Note that the pitting potential $Vc'_{10}$ in Table 1 indicates the pitting potential when the current density is 10 $\mu A/cm^2$.

TABLE 1

| | Composition (wt %) | | | | | | | Pitting Potential $Vc'_{10}$ (mV) | |
|---|---|---|---|---|---|---|---|---|---|
| | C | Si | Mn | Ni | Cr | Mo | Fe | Base Material | Passive State Coating |
| 1 | 0.017 | 0.58 | 0.82 | 12.03 | 16.40 | 0.10 | balance | 322 | 480 |
| 2 | 0.011 | 0.36 | 1.55 | 12.45 | 16.30 | 2.01 | balance | 337 | 1031 |
| 3 | 0.013 | 0.38 | 1.59 | 13.46 | 16.48 | 2.50 | balance | 346 | 1085 |
| 4 | 0.018 | 0.40 | 0.60 | 14.39 | 16.60 | 2.95 | balance | 386 | 1094 |
| 5 | 0.015 | 0.36 | 1.28 | 13.85 | 16.52 | 3.98 | balance | 672 | 1029 |
| 6 | 0.009 | 0.18 | 1.38 | 23.88 | 22.29 | 4.85 | balance | 850 | 973 |
| 7 | 0.011 | 0.18 | 1.39 | 33.21 | 22.29 | 6.68 | balance | 886 | 936 |
| 8 | 0.007 | 0.17 | 0.38 | 38.08 | 22.07 | 8.55 | balance | 818 | 908 |
| 9 | 0.003 | 0.04 | 0.50 | balance | 15.20 | 15.7 | 5.9 | 653 | 678 |
| 10 | 0.003 | 0.03 | 0.18 | balance | 21.16 | 13.3 | 4.5 | 641 | 673 |

As shown in Table 1 and FIG. 1, as for the test pieces using the base material, it is have a higher pitting potential and an improved pitting resistance when the added Mo amount exceeds 3 to 4 wt. %. For the test pieces with a passive state coating on the surface of the base material, however, addition of Mo for 1.5 to 8.5 wt. % forms passive state coatings with a pitting potential of 900 mV or more. In particular, when 2.0 to 4.0 wt. % of Mo is added, the passive state coating has a pitting potential exceeding 1000 mV.

In addition, it is observed that, for the test pieces with the passive state coatings having a pitting potential of 900 mV or more, the coating thickness is 0.5 to 20 nm, and this causes the stainless steel to have a high pitting potential.

The stainless steel member for semiconductor fabrication equipment of the present invention with a passive state coating having a pitting potential of 900 mV or more has an excellent corrosion resistance.

EXAMPLE 2

Test pieces having an area of 15 mm×15 mm and a thickness of 5 mm adjusted to have the composition Nos. 4, 11 and 12 shown in Table 2 are buffed so that their surface roughness becomes Rmax: 0.05 μm. Note that REM value in Table 2 indicates the total of Pr and Ce. The metal elution amount and the pitting potential are measured with using these test pieces. The measurement conditions for metal elution amount are as follows:

Metal Elution Amount

A test piece exposing its tested surface of 1 $cm^2$ is immersed in aqueous 35% hydrochloric acid solution diluted by ultrapure water having a resistivity of 18 MΩ·cm in a Teflon crucible. It is further sealed in a metal container, which is entirely maintained at 60° C. for two hours. Then, the metal amount eluted in 35% aqueous hydrochloric acid solution is determined with an inductively coupled plasma emission spectrometer. Table 2 shows the measurement results.

Similarly, 5 mm thick stainless steel test pieces having a diameter of 10 mm adjusted to have the composition Nos. 4, 11 and 12 in Table 2 are subjected to electrolytic polishing so that their surface roughness becomes Rmax: 0.05 μm. They are immersed in aqueous nitric acid solution kept at 50° C. (nitric acid concentration of 40 vol. %) for 35 minutes. They are cleaned and dried and then heated at 350° C. for one hour in the atmosphere of excessively low oxygen (0.06 ppm). The atmosphere gas used here is Ar gas of high purity having a water dew temperature below −70° C. The test pieces thus prepared are subjected to pitting potential determination. The results are also shown in Table 2.

Note that pitting potentials $Vc'_{10}$ and $Vc'_{100}$ in Table 2 indicate the pitting potentials for current density of 10 $\mu A/cm^2$ and 100 $\mu A/cm^2$ respectively.

TABLE 2

| | Composition (wt %) | | | | | | | | | | Metal Elution Amount ($mg/cm^2$) | | | | Pitting Potential (mV) Base Material | | Pitting Potential (mV) Passive State Coating | |
|---|---|---|---|---|---|---|---|---|---|---|---|---|---|---|---|---|---|---|
| | C | Si | Mn | P | S | Ni | Cr | Mo | REM | Fe | Fe | Cr | Ni | tot. | $Vc'_{10}$ | $Vc'_{100}$ | $Vc'_{10}$ | $Vc'_{100}$ |
| 4 | 0.018 | 0.40 | 0.60 | 0.027 | 0.001 | 14.39 | 16.60 | 2.95 | 0 | balance | 5.1 | 1.3 | 1.1 | 7.5 | 386 | 406 | 1094 | 1102 |
| 11 | 0.01 | 0.63 | 0.88 | 0.030 | 0.001 | 15.9 | 16.7 | 3.0 | 0.05 | balance | 2.6 | 0.7 | 0.6 | 3.9 | 372 | 395 | 1015 | 1029 |
| 12 | 0.03 | 0.55 | 1.38 | 0.025 | 0.001 | 14.6 | 16.4 | 1.0 | 0 | balance | 18.3 | 4.5 | 0.4 | 23.2 | 325 | 334 | 673 | 783 |

Table 2 shows that the test piece with base material of No. 11 composition including rare earth elements has a less metal elution amount compared with those having composition Nos. 4 and 12. In other words, improved corrosion resistance of the base material, which is attributed to rare earth element addition, decreases the metal elution amount.

In addition, the passive state coatings formed on the surface of the base material Nos. 4 and 11 exhibit pitting potential of 1000 mV or more.

Figure 2:
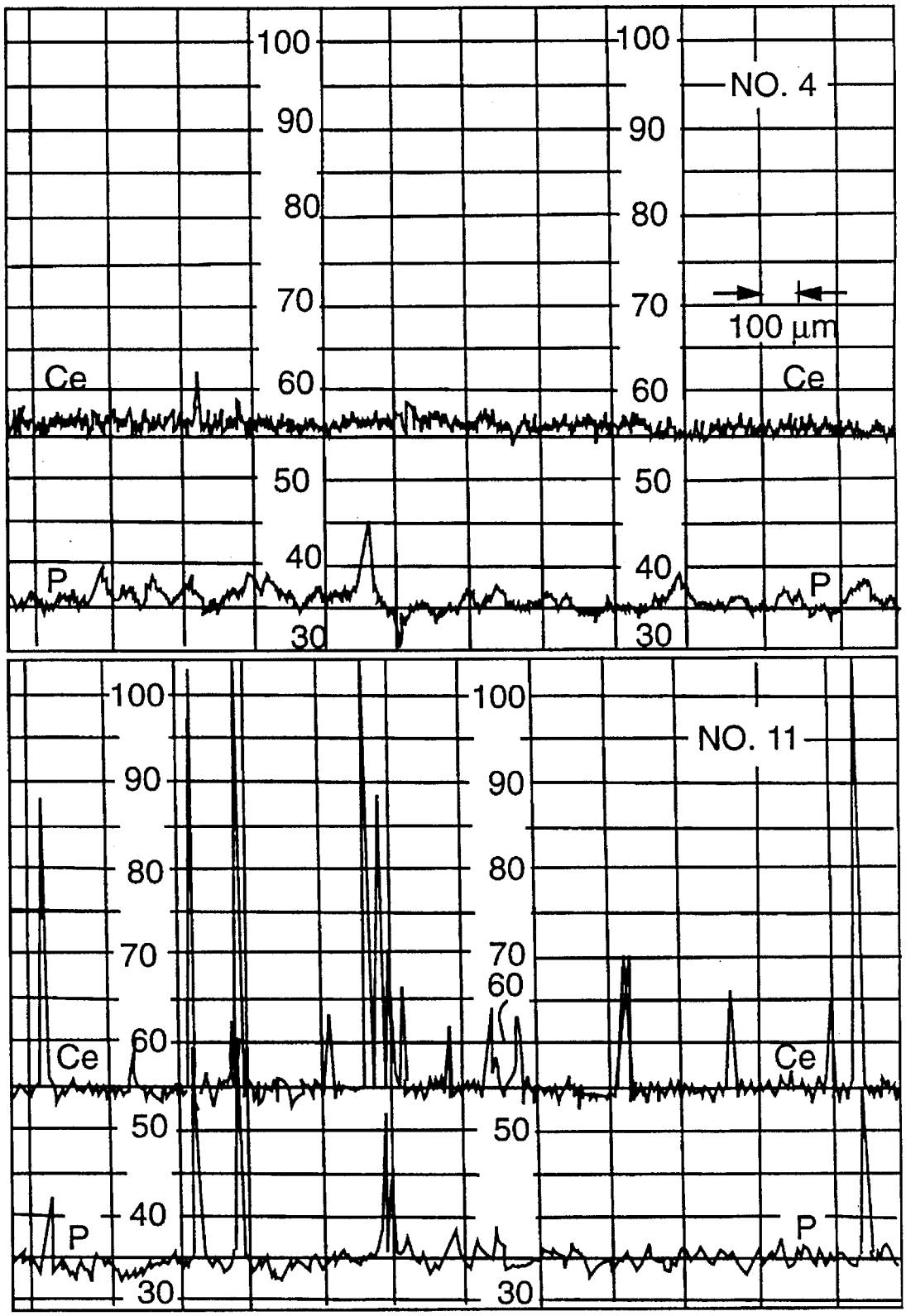
FIG. 2 is a diagram to show the results of EPMA line analysis on P element behavior caused by addition of a rare earth element to the material according to the present invention.

FIG. 2 shows EPMA (electron probe X-ray micro analyzer) measurement results of the behavior of P and rare earth elements in Nos. 4 and 11. No. 11 containing rare earth elements has the peak of the rare earth elements and P at the same position. It suggests that P and the rare earth elements form chemical compounds.

P is known as an element which deteriorates the corrosion resistance of the stainless steel when existing as solid solution in matrix. However, in the present invention, it forms chemical compounds with rare earth elements and forms little solid solution, which improves the corrosion resistance of the base material.

For No. 11 test piece in Table 2, the intensity changes of $Fe_2P_{3/2}$ and $Cr_2P_{3/2}$ in the surface after electrolytic polishing, nitric acid treatment and heating are respectively determined by means of XPS (X-ray photoelectron spectroscopy). FIG. 3 shows the results: decrease of $Fe_2P_{3/2}$ is more significant after heating than after nitric acid treatment, which is still more than after electrolytic polishing; increase of $Cr_2P_{3/2}$ is more significant after heating than after nitric acid treatment, which is still more than after electrolytic polishing.

EXAMPLE 3

A plurality of test pieces having the composition No. 11 in Table 2 of Example 2, an area of 15 mm×15 mm and a thickness of 5 mm are prepared and divided into two groups. One of them are subjected to electrolytic polishing so as to be provided with a surface roughness of Rmax: 0.05 μm. They are immersed in aqueous nitric acid solution (nitric acid concentration of 40 vol. %) maintained at 50° C. for 35 minutes. After being cleaned and dried, they are heated for one hour in the atmosphere with excessively low oxygen content (0.06 ppm) at 350° C. The atmospheric gas here is highly pure Ar gas having a water dew temperature below −70° C. to form the atmosphere with excessively low oxygen (to be referred to as sample No. 11). The other group pieces are subjected to electrolytic polishing according to Japanese Patent Application Laid-open No. 31956/1989, and heated at 400° C. for one hour in highly pure oxygen atmosphere (to be referred to as sample No. 13). For corrosion resistance evaluation, the metal elution amount and pitting potential are determined for both of them by the same methods used in Example 2. The Results are shown in Table 3.

TABLE 3

| | Pitting Potential (mV) | | Metal Elution |
|---|---|---|---|
| | $Vc'_{10}$ | $Vc'_{100}$ | Amount ($mg/cm^2$) |
| 11 | 1015 | 1029 | 3.9 |
| 13 | 212 | 224 | 60.3 |

As seen from Table 3, the present invention provides a better corrosion resistance than the comparative example.

Next, diaphragm valves made of materials with same composition and surface treatment as Nos. 11 and 13 are left in the air. Then, Ar gas is supplied and the water content in the Ar gas at the outlet is measured with a trace moisture meter. The results are shown in FIG. 4. As obviously shown in FIG. 4, the valve according to the present invention provides an equivalent water desorption property to the comparative example.

EXAMPLE 4

Test pieces having No. 11 composition in Table 2 of Example 2 with a diameter of 10 mm and a thickness of 5 mm are prepared. They are electrolytically polished to have surface roughness of Rmax: 10 nm or less on a grain. Then, they are immersed in aqueous nitric acid solution (nitric acid concentration of 30 vol. %) kept at 60° C. for 30 minutes. After being cleaned and dried, they are heated in the atmosphere with excessively low oxygen under various heating temperatures as shown in Table 4. To obtain excessively low oxygen atmosphere, highly pure Ar gas having a water dew point temperature below −70° C. is used as the atmospheric gas. The surface roughness and the passive state coating thickness are determined for these samples.

Figure 5:
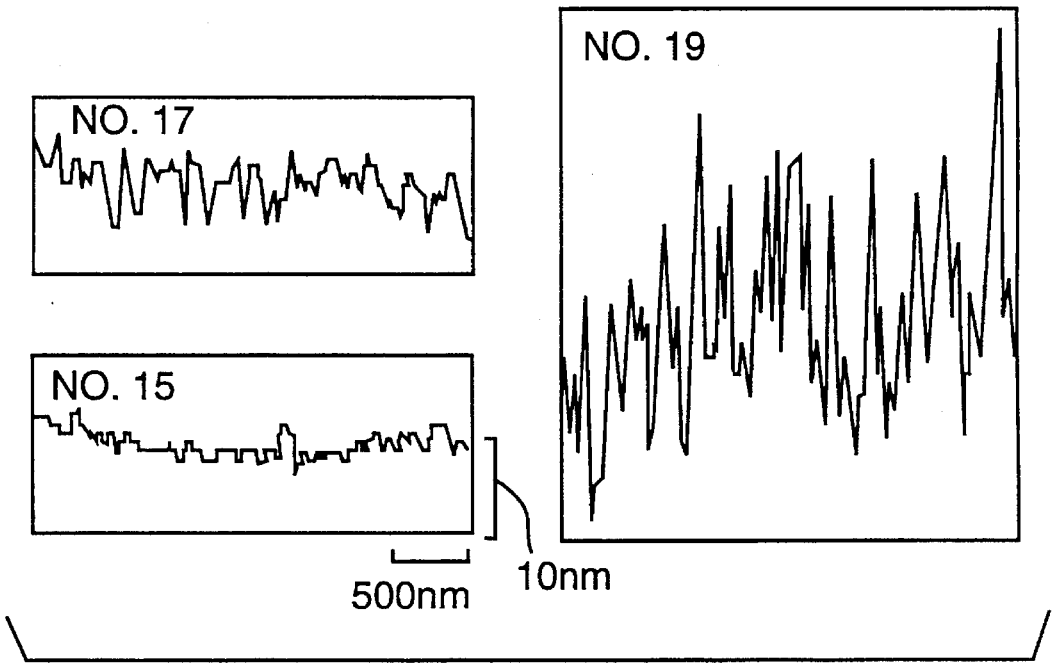
FIG. 5 is a graph to show the difference in surface properties of the material according to the present invention for different heating temperatures.

Table 4 and FIG. 5 show the surface property inspection results for the passive state coating surface using a scanning tunneling microscope (STM). The surface roughness in Table 4 shows Rmax values of the passive state coating on a grain. As understood from table 4 and FIG. 5, heating temperature of 450° C. or more results in a higher surface roughness of the coating: Rmax of 30 nm or more.

Diaphragm valves with the same surface treatment as the sample Nos. 15, 17 and 19 in Table 4 are left in the air. Then, Ar gas is supplied and the water content in the Ar gas at the outlet is measured with a trace moisture meter. Measurement conditions are as follows.

Water Desorption Property

After measurement at room temperature for three hours, the diaphragm valves are heated to 80° C. and measured for three hours, and then measured at 120° C. for three hours and at room temperature for 15 hours. The measurement results are shown in FIG. 6.

Figure 6:
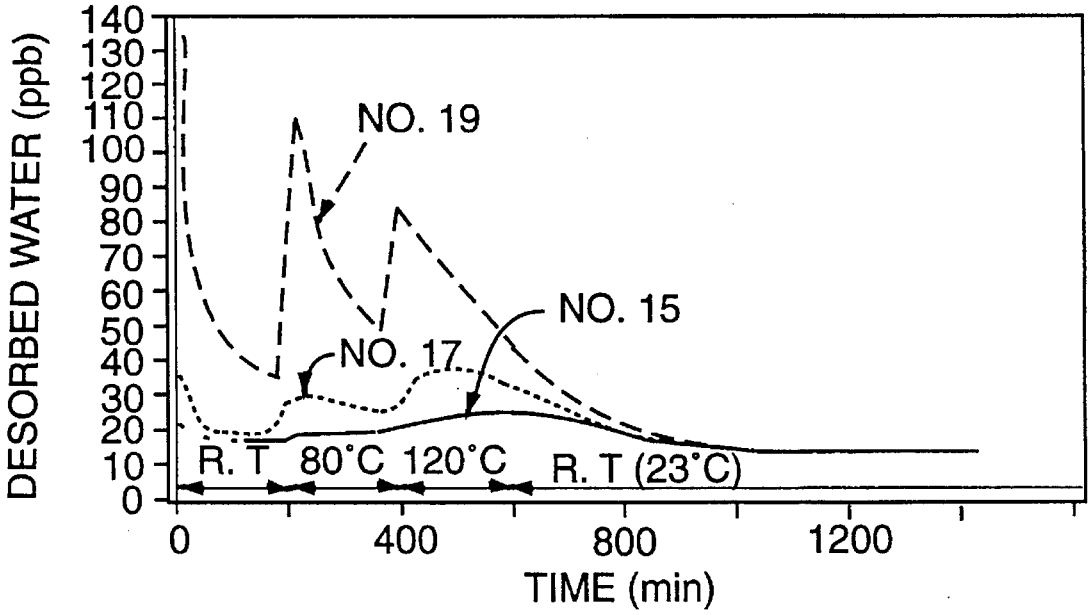
FIG. 6 is a graph to show the water desorption from a diaphragm valve according to the present invention.

As seen from FIG. 6, sample Nos. 15 and 17 have excellent water desorption property compared with sample No. 19. In the case of sample No. 19, rough surface roughness on the crystal grain causes the water molecules to be caught by recesses on the surface, which are detected at each heating process.

Thus, it is understood that the water desorption property can be improved by heating of the passive state coating on the stainless steel member to provide Rmax of 30 nm or less on each grain.

TABLE 4

| | Surface Treatment Condition | | Surface | Passive State |
|---|---|---|---|---|
| | Heating Temp. (C.) | Heating Period (hr.) | Roughness Rmax (nm) | Coating Thickness (nm) |
| 14 | 200 | 1 | 12.4 | 2 |
| 15 | 250 | 1 | 12.2 | 3 |
| 16 | 300 | 1 | 17.0 | 4 |
| 17 | 400 | 1 | 22.4 | 5 |
| 18 | 450 | 1 | 38.6 | 6 |
| 19 | 500 | 1 | 44.1 | 7 |

As describe above, the present invention enables a stainless steel member excellent in both of corrosion resistance and water desorption property. The member is quite advantageous to be used in ultra-pure water supply pipes, gas supply pipes, gas bomb and reaction chamber in semiconductor fabrication equipment.

What is claimed is:

1. A stainless steel member for semiconductor fabrication equipment having a passive state coating with a pitting potential of at least 900 mV (when the current density of the anode polarization curve determined with a potentiostat in 3.5% aqueous sodium chloride solution is 10 $\mu A/cm^2$).

2. A stainless steel member according to claim 1 wherein said passive state coating has a thickness of 0.5 to 20 nm.

3. A stainless steel member for semiconductor fabrication equipment having a passive state coating on the surface of the stainless steel comprising, in weight percent, 0.1% or less of C, 2.0% or less of Si, 3.0% or less of Mn, 10% or more of Ni, 15 to 25% of Cr, 1.5 to 4.5% of Mo and Fe for substantially the whole remainder, said passive state coating having a pitting potential of at least 900 mV (when the current density of the anode polarization curve determined with a potentiostat in 3.5% aqueous sodium chloride solution is 10 $\mu A/cm^2$).

4. A stainless steel member according to claim 3 wherein Mo represents 2.0 to 4.0%.

5. A stainless steel member for semiconductor fabrication equipment comprising, in weight percent, 0.1% or less of C, 2.0% or less of Si, 3.0% or less of Mn, 10% or more of Ni, 15 to 25% of Cr, 1.5 to 4.5% of Mo, 0.5% or less of one or more rare earth element and Fe for substantially the whole remainder; and a passive state coating on the surface of the stainless steel, said passive state coating being formed by immersing the stainless steel in an aqueous nitric acid solution and heating the stainless steel member in a low oxygen atmosphere;

said passive state coating having a pitting potential of at least 900 mV (when the current density of the anode polarization curve determined with a potentiostat in 3.5% aqueous sodium chloride solution is 10 $\mu A/cm^2$).

6. A stainless steel member for semiconductor fabrication equipment having a passive state coating on the surface of the stainless steel comprising, in weight percent, 0.1% or less of C, 2.0% or less of Si 3.0% or less of Mn, 10% or more of Ni, 15 to 25% of Cr, 1.5 to 4.54 of Mo, 0.54 or less of one or more rare earth element and Fe for substantially the whole remainder, said passive state coating having a pitting potential of at least 900 mV (when the current density of the anode polarization curve determined with a potentiostat in 3.5% aqueous sodium chloride solution is 10 $\mu A/cm^2$).

7. A stainless steel member according to claim 6 wherein Mo represents 2.0 to 4.0%.

8. A surface treatment method for a stainless steel member used in semiconductor fabrication equipment, comprising the sequential steps of:

immersing the stainless steel member in an aqueous nitric acid solution, thereby forming a coating richer in Cr than the interior of the stainless steel member, and heating the stainless steel member in an atmosphere having 0.1 ppm or less oxygen at 200° to 900° C., thereby forming a passive state coating.

9. A surface treatment according to claim 8, wherein the heating step occurs at a temperature of 200° to 400° C.

10. A surface treatment method for a stainless steel member used in semiconductor fabrication equipment, comprising the sequential steps of:

immersing the stainless steel member in an aqueous nitric acid solution, thereby forming a coating richer in Cr than the interior of the stainless steel member, and heating the stainless steel member in an atmosphere having 0.1 ppm or less oxygen at 200° to 900° C., thereby forming a passive state coating, wherein the stainless steel member comprises in weight percent 0.1% or less C, 2.0% or less Si, 3.0% or less Mn, 10 % or more Ni, 15–25% Cr, 1.5–4.5% Mo, and the remainder Fe.

11. A surface treatment method for a stainless steel member used in semiconductor fabrication equipment, comprising the sequential steps of:

immersing the stainless steel member in an aqueous nitric acid solution, thereby forming a coating richer in Cr than the interior of the stainless steel member, and heating the stainless steel member in an atmosphere having 0.1 ppm or less oxygen at 200° to 900° C., thereby forming a passive state coating, wherein the stainless steel member comprises in weight percent 0.1% or less C, 2.0% or less Si, 3.0% or less Mn, 10% or more Ni, 15–25% Cr, 1.5–4.5% Mo, 0.5% or less of one or more rare earth elements, and the remainder Fe.

* * * * *

UNITED STATES PATENT AND TRADEMARK OFFICE

CERTIFICATE OF CORRECTION

PATENT NO. : 5,569,334

DATED : October 29, 1996

INVENTOR(S) : Tsunehiro KAWATA et al.

It is certified that error appears in the above-indentified patent and that said Letters Patent is hereby corrected as shown below:

Claim 6, col 10, line 31, replace "Si 3.0%" with -- Si, 3.0%--;

line 32, replace "4.54" with --4.5%-- and "0.54" with --0.5%--.

Signed and Sealed this

Twenty-fourth Day of December, 1996

*Attest:*

Bruce Lehman

BRUCE LEHMAN

*Attesting Officer*

*Commissioner of Patents and Trademarks*